US010934786B2

(12) United States Patent
Drenth et al.

(10) Patent No.: US 10,934,786 B2
(45) **Date of Patent: *Mar. 2, 2021**

(54) DRILL STRING COMPONENTS RESISTANT TO JAMMING

(71) Applicant: BLY IP INC., Salt Lake City, UT (US)

(72) Inventors: Christopher L. Drenth, Burlington (CA); Keith William Littlely, Clarkson (AU)

(73) Assignee: BLY IP INC., Salt Lake City, UT (US)

( * ) Notice: Subject to any disclaimer, the term of this patent is extended or adjusted under 35 U.S.C. 154(b) by 114 days.

This patent is subject to a terminal disclaimer.

(21) Appl. No.: 16/444,660

(22) Filed: Jun. 18, 2019

(65) Prior Publication Data

US 2019/0301248 A1 Oct. 3, 2019

Related U.S. Application Data

(63) Continuation of application No. 15/727,183, filed on Oct. 6, 2017, now Pat. No. 10,364,618, which is a continuation of application No. 13/354,189, filed on Jan. 19, 2012, now Pat. No. 9,810,029.

(60) Provisional application No. 61/436,331, filed on Jan. 26, 2011.

(51) Int. Cl.
*E21B 17/042* (2006.01)

(52) U.S. Cl.
CPC ..... *E21B 17/042* (2013.01)

(58) Field of Classification Search
CPC ..... E21B 17/042; E21B 17/022
See application file for complete search history.

(56) References Cited

U.S. PATENT DOCUMENTS

| | | | | | |
|---|---|---|---|---|---|
| 5,320,467 | A * | 6/1994 | Erbes | F16B 35/047 | 411/386 |
| 5,810,401 | A * | 9/1998 | Mosing | E21B 17/0426 | 285/333 |
| 6,158,785 | A * | 12/2000 | Beaulier | E21B 17/042 | 285/334 |
| 6,435,569 | B1 * | 8/2002 | Hopkins | F16L 15/004 | 285/334 |
| 7,178,391 | B2 * | 2/2007 | Casper | E21B 17/042 | 175/59 |
| 9,810,029 | B2 * | 11/2017 | Drenth | E21B 17/042 | |
| 10,364,618 | B2 * | 7/2019 | Drenth | E21B 17/042 | |
| 2003/0168859 | A1 * | 9/2003 | Watts | F16L 15/004 | 285/334 |
| 2010/0123311 | A1 * | 5/2010 | Church | F16L 15/001 | 285/334 |

(Continued)

*Primary Examiner* — James M Hewitt, II
(74) *Attorney, Agent, or Firm* — Ballard Spahr LLP

(57) ABSTRACT

A drill string components having a thread extending around a body. The leading end of the thread can have a configuration that resists jamming and cross-threading. In particular, the leading end of the thread can include a planar surface normal to the body. The leading end of the thread can provide an abrupt transition to full thread depth that helps reduce or eliminate cross-threading. The leading end of the thread can be oriented at an angle relative to the axis of the drill string component. When mating male and female threads are similarly structured, the mating threads slide together along an interface at the thread start face and are drawn into a fully thread-coupled condition. The thread starts may have full circumference mating with no jamming positions.

20 Claims, 3 Drawing Sheets

(56) References Cited

U.S. PATENT DOCUMENTS

2012/0273233 A1* 11/2012 Drenth ..... E21B 17/042
166/380

* cited by examiner

DRILL STRING COMPONENTS RESISTANT TO JAMMING

CROSS-REFERENCE TO RELATED APPLICATIONS

This application is a continuation of co-pending U.S. patent application Ser. No. 15/727,183, filed Oct. 6, 2017, which is a continuation of U.S. patent application Ser. No. 13/354,189, filed on Jan. 19, 2012, which is now U.S. Pat. No. 9,810,029, issued Nov. 7, 2017, which claims priority to U.S. Provisional Application No. 61/436,331, filed on Jan. 26, 2011. The disclosure of each of the above-referenced applications is hereby incorporated herein by reference in its entirety.

BACKGROUND OF THE INVENTION

1. The Field of the Invention

Implementations of the present invention relate generally to components and system for drilling. In particular, implementations of the present invention relate to drill components that resist jamming during make-up.

2. The Relevant Technology

Threaded connections have been well known for ages, and threads provide a significant advantage in that a helical structure of the thread can convert a rotational movement and force into a linear movement and force. Threads exist on many types of elements, and can be used in limitless applications and industries. For instance, threads are essential to screws, bolts, and other types of mechanical fasteners that may engage a surface (e.g., in the case of a screw) or be used in connection with a nut (e.g., in the case of a bolt) to hold multiple elements together, apply a force to an element, or for any other suitable purpose. Threading is also common in virtually any industry in which elements are mechanically fastened together. For instance, in plumbing applications, pipes are used to deliver liquids or gasses under pressure. Pipes may have threaded ends that mate with corresponding threads of an adjoining pipe, plug, adaptor, connector, or other structure. The threads can be used in creating a fluid-tight seal to guard against fluid leakage at the connection site.

Oilfield, exploration, and other drilling technologies also make extensive use of threading. For instance, when a well is dug, casing elements may be placed inside the well. The casings generally have a fixed length and multiple casings are secured to each other in order to produce a casing of the desired height. The casings can be connected together using threading on opposing ends thereof. Similarly, as drilling elements are used to create a well or to place objects inside a well, a drill rod or other similar device may be used. Where the depth of the well is sufficiently large, multiple drill rods may be connected together, which can be facilitated using mating threads on opposing ends of the drill rod. Often, the drill rods and casings are very large and machinery applies large forces in order to thread the rods or casings together.

Significant efforts have been made to standardize threading, and multiple threading standards have been developed to allow different manufacturers to produce interchangeable parts. For instance exemplary standardization schemes include Unified Thread Standard (UTS), British Standard Whitworth (BSW), British Standard Pipe Taper (BSPT), National Pipe Thread Tapered Thread (NPT), International Organization for Standardization (ISO) metric screw threads, American Petroleum Institute (API) threads, and numerous other thread standardization schemes.

While standardization has allowed greater predictability and interchangeability when components of different manufactures are matched together, standardization has also diminished the amount of innovation in thread design. Instead, threads may be created using existing cross-sectional shapes—or thread form—and different combinations of thread lead, pitch, and number of starts. In particular, lead refers to the linear distance along an axis that is covered in a complete rotation. Pitch refers to the distance from the crest of one thread to the next, and start refers to the number of starts, or ridges, wrapped around the cylinder of the threaded fastener. A single-start connector is the most common, and includes a single ridge wrapped around the fastener body. A double-start connector includes two ridges wrapped around the fastener body. Threads-per-inch is also a thread specification element, but is directly related to the thread lead, pitch, and start.

While existing threads and thread forms are suitable for a number of applications, continued improvement is needed in other areas. For instance, in high torque, high power, and/or high speed applications, existing thread designs are inherently prone to jamming. Jamming is the abnormal interaction between the start of a thread and a mating thread, such that in the course of a single turn, one thread partially passes under another, thereby becoming wedged therewith. Jamming can be particularly common where threaded connectors are tapered.

In tapered threads, the opposing ends of male and female components may be different sizes. For instance, a male threaded component may taper and gradually increase in size as distance from the end increases. To accommodate for the increase in size, the female thread may be larger at the end. The difference in size of tapered threads also makes tapered threads particularly prone to jamming, which is also referred to as cross-threading. Cross-threading in tapered or other threads can result in significant damage to the threads and/or the components that include the threads. Damage to the threads may require replacement of the threaded component, result in a weakened connection, reduce the fluid-tight characteristics of a seal between components, or have other effects, or any combination of the foregoing.

For example, tail-type thread starts have crests with a joint taper. If the male and female components are moved together without rotation, the tail crests can wedge together. If rotated, the tail crests can also wedge when fed based on relative alignment of the tails. In particular, as a thread tail is typically about one-half the circumference in length, and since the thread has a joint taper, there is less than half of the circumference of the respective male and female components providing rotational positioning for threading without wedging. Such positional requirements may be particularly difficult to obtain in applications where large feed and rotational forces are used to mate corresponding components. For instance, in the automated making of coring rod connections in the drilling industry, the equipment may operate with sufficient forces such that jamming, wedging, or cross-threading is an all too common occurrence.

Furthermore, when joining male and female components that are in an off-center alignment, tail-type connections may also be prone to cross-threading, jamming, and wedging. Accordingly, when the male and female components are fed without rotation, the tail can wedge into a mating thread. Under rotation, the tail may also wedge into a mating thread. Wedging may be reduced, but after a threading opportunity (e.g., mating the tip of the tail in opening adjacent a mating tail), wedging may still occur due to the missed threading opportunity and misalignment. Off-center threads may be configured such that a mid-tail crest on the mail component has equal or corresponding geometry relative to the female thread crest.

As discussed above, threaded connectors having tail-type thread starts can be particularly prone to thread jamming, cross-threading, wedging, joint seizure, and the like. Such difficulties may be particularly prevalent in certain industries, such as in connection with the designs of coring drill rods. The thread start provides a leading end, or first end, of a male or female thread and mates with that of a mating thread to make a rod or other connection. If the tail-type thread starts jam, wedge, cross-thread, and the like, the rods may need to be removed from a drill site, and can require correction that requires a stop in drilling production.

Additionally, drill rods commonly make use of tapered threads, which are also prone to cross-threading difficulties. Since a coring rod may have a tapered thread, the tail at the start of the male thread may be smaller in diameter than that of the start of the female thread. As a result, there may be transitional geometry at the start of each thread to transition from a flush to a full thread profile. Because the thread start and transitional geometry may have sizes differing from that of the female thread, the transitional geometry and thread start may mate abnormally and wedge into each other.

If there is a sufficient taper on the tail, the start of the male thread may have some clearance to the start of the female thread, such as where the mid-tail geometry corresponds to the geometry of the female thread. However, the transitional geometry of the start of the thread may nonetheless interact abnormally with turns of the thread beyond the thread start, typically at subsequent turns of mating thread crests, thereby also resulting in jamming, cross-threading, wedging, and the like. Thus, the presence of a tail generally acts as a wedge with a mating tail, thereby increasing the opportunity and probability of thread jamming.

In certain applications, such as in connection with drill rigs, multiple drill rods, casings, and the like can be made up. As more rods or casings are added, interference due to wedging or cross-threading can become greater. Indeed, with sufficient power (e.g., when made up using hydraulic power of a drill rig) a rod joint can be destroyed. Coring rods in drilling applications also often have threads that are coarse with wide, flat threaded crests parallel to mating crests due to a mating interference fit or slight clearance fit dictated by many drill rod joint designs. The combination of thread tails and flat, parallel thread crests on coarse tapered threads creates an even larger potential for cross-threading interaction, which may not otherwise be present in other applications.

The limitations of tail-type thread designs are typically brought about by limitations of existing machining lathes. In particular, threads are typically cut by rotational machining lathes which can only gradually apply changes in thread height or depth with rotation of the part. Accordingly, threads are generally formed to include tails having geometry and tails identical or similar to other portions of the thread start. For instance, among other things, traditional lathes are not capable of applying an abrupt vertical or near vertical transition from a flush to full thread profile to rotation of the part during machining. The gradual change is also required to remove sharp, partial feature edges of material created where the slight lead, or helix angle, of the thread meets the material being cut.

Thus, drawback with traditional threads can be exacerbated with drilling components. In particular, the joints of the drill string components can require a joint with a high tension load capacity due to the length and weight of many drill strings. Furthermore, the joint will often need to withstand numerous makes and breaks since the same drill string components may be installed and removed from a drill string multiple times during drilling of a borehole. Similarly, the drill string components may be reused multiple times during their life span. Compounding these issues is the fact that many drilling industries, such as exploration drilling, require the use of thin-walled drill string components. The thin-wall construction of such drill string components can restrict the geometry of the threads.

Accordingly, a need exists for an improved thread design that reduces jamming and cross threading.

BRIEF SUMMARY OF THE INVENTION

One or more implementations of the present invention overcome one or more of the foregoing or other problems in the art with drilling components, tools, and systems that provide for effective and efficient making of threaded joints. For example, one or more implementations of the present invention include drill string components resistant to jamming and cross-threading. Such drill string components can reduce or eliminate damage to threads due to jamming and cross-threading. In particular, one or more implementations include drill string components having threads with a leading end or thread start oriented at an acute angle relative to the central axis of the drill string component. Additionally or alternatively, the leading end of the thread can provide an abrupt transition to full thread depth and/or width.

For example, one implementation of a threaded drill string component that resists jamming and cross-threading includes a hollow body having a first end, an opposing second end, and a central axis extending through the hollow body. The drill string component also includes a thread positioned on the first end of the hollow body. The thread comprises a plurality of helical turns extending along the first end of the hollow body. The thread has a thread depth and a thread width. The thread comprises a leading end proximate the first end of the hollow body. The leading end of the thread is orientated at an acute angle relative to the central axis of the hollow body. The leading end of the thread faces toward an adjacent turn of the thread.

Additionally, another implementation of a threaded drill string component that resists jamming and cross threading includes a body, a box end, an opposing pin end, and a central axis extending through the body. The drill string component also includes a female thread positioned on the box end of the body. The female thread has a depth and a width. Additionally, the drill string component also includes a male thread positioned on the pin end of the body. The male thread has a depth and a width. Each of the female thread and the male thread comprises a leading end. The leading end of each of the female thread and the male thread comprises a planar surface extending normal to the body. The planar surface of the leading end of the female thread extends along the entire width and the entire depth of the female thread. Similarly, the planar surface of the leading end of the male thread extends along the entire width and the entire depth of the male thread.

In addition to the foregoing, an implementation of a method of making a joint in a drill string without jamming or cross threading involves inserting a pin end of a first drill string component into a box end of a second drill string component. The method also involves rotating the first drill sting component relative to the second drill string component; thereby abutting a planar leading end of a male thread on the pin end of the first drill string component against a planar leading end of a female thread on the box end of the second drill string component. The planar leading end of the male thread is oriented at an acute angle relative to a central axis of the first drill string component. Similarly, the planar leading end of the female thread is oriented at an acute angle relative to a central axis of the second drill string component. Additionally, the method involves sliding the planar leading end of the male thread against and along the planar leading end of the female thread to guide the male thread into a gap between turns of the female thread.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Implementations of the present invention are directed toward drilling components, tools, and systems that provide for effective and efficient making of threaded joints. For example, one or more implementations of the present invention include drill string components resistant to jamming and cross-threading. Such drill string components can reduce or eliminate damage to threads due to jamming and cross-threading. In particular, one or more implementations include drill string components having threads with a leading end or thread start oriented at an acute angle relative to the central axis of the drill string component. Additionally or alternatively, the leading end of the thread can provide an abrupt transition to full thread depth and/or width.

Reference will now be made to the drawings to describe various aspects of one or more implementations of the invention. It is to be understood that the drawings are diagrammatic and schematic representations of one or more implementations, and are not limiting of the present disclosure. Moreover, while various drawings are provided at a scale that is considered functional for one or more implementations, the drawings are not necessarily drawn to scale for all contemplated implementations. The drawings thus represent an exemplary scale, but no inference should be drawn from the drawings as to any required scale.

In the following description, numerous specific details are set forth in order to provide a thorough understanding of the present invention. It will be obvious, however, to one skilled in the art that the present disclosure may be practiced without these specific details. In other instances, well-known aspects of thread specifications, thread manufacturing, in-field equipment for connecting threaded components, and the like have not been described in particular detail in order to avoid unnecessarily obscuring aspects of the disclosed implementations.

Figure 1:
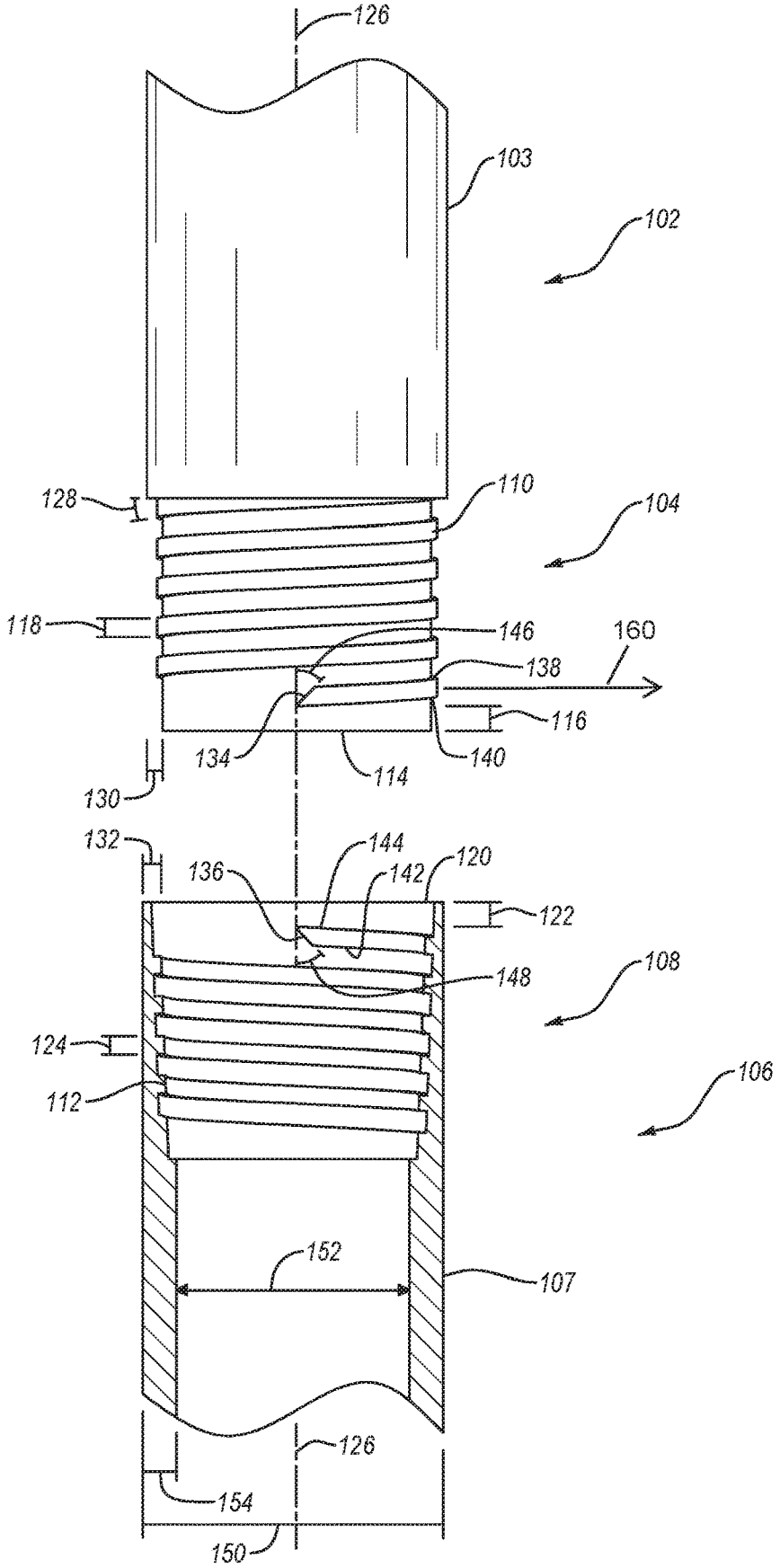
FIG. 1 illustrates a side view of a male end of a drill string component and a cross-sectional view of a female end of another drill string component each having a thread with a leading end in accordance with one or more implementations of the present invention.

Turning now to FIG. 1, an implementation of threaded drill string components are illustrated. The threaded drill string components can be joined while avoiding or reducing the risk of cross-threading or jamming are described in particular detail below. As shown by FIG. 1, a first drill string component 102 can comprise a body 103 and a male connector or pin end 104. A second drill string component 106 can include a body 107 and a female connector or box end 108. The pin end 104 of the first drill string component 106 can be configured to connect to the box end 108 of the second drill string component 106.

In one or more implementations, each drill string component 102, 106 can comprise a hollow body having a central axis 126 extending there through as shown in FIG. 1. In alternative implementations, one or more of the drill string components 102, 106 can comprise a solid body (such as a percussive drill rod or drill bit) or a partially hollow body.

The pin end 104 can include a male thread 110 (i.e., a thread that projects radially outward from outer surface of the pin end 104). The box end 108, on the other hand, can include a female thread 112 (i.e., a thread that projects radially inward from an inner surface of the box end 108). The male thread 110 and the female thread 112 can have generally corresponding characteristics (e.g., lead, pitch, threads per inch, number of thread starts, pitch diameter, etc.). In one or more implementations, the male and female threads 110, 112 include straight threads, in alternative implementations, the male and female threads 110, 112 are tapered. Accordingly, while the male and female threads 110, 112 may have corresponding characteristics, it is not necessary that threads 110, 112 be uniform along their entire length. Indeed, male thread 110 may have characteristics corresponding to those of female thread 112 despite the characteristics changing along the respective lengths of pin end 104 or box end 108.

In one or more implementations, the male and female threads 110, 112 can include characteristics the same as or similar to those described in U.S. Pat. No. 5,788,401, the entire contents of which are incorporated by reference herein. For example, in one or more implementations, the male and female threads 110, 112 can comprise single start, helical tapered threads. The male and female threads 110, 112 can have frusta-conical crests and roots with the taper being about 0.75 to 1.6 degrees. The male and female threads 110, 112 can have a pitch of about 2.5 to 4.5 threads/inch.

Trailing edges 138, 144 of the male and female threads 110, 112 can each be oriented at respective negative pressure flank angles of about 7.5 to 15 degrees relative to a respective transverse axis (such as transverse axis 160, as shown in FIG. 1) that is perpendicular to the drill string, and leading edges 140, 142 of the male and female threads can define clearance flanks of an angle of at least 45 degrees relative to the respective transverse axis to aid in maintaining the joint in a coupled condition, even under overload, and facilitate joint make up. Also, the box end and pin end can have shoulders tapered at about 5 to 10 degrees. Additionally, the pin crests can have an interference fit with the box roots while the box crests are radially spaced from the pin roots to provide a rigid joint while leaving a space for debris and pressurized lubricant. One will appreciate in light of the disclosure herein the foregoing description is just one configuration for the male and female threads 110, 112. In alternative implementations, the configuration of the male and female threads 110, 112 can differ from the forgoing description.

As shown in FIG. 1, the threads 110, 112 are illustrated as having a generally rectangular thread form. Such thread form is merely one possible thread form that may be used. However, threads consistent with the disclosure herein may have other thread forms. For instance, a thread form may include a square, triangular, trapezoidal, or other shape.

In one or more implementations, the pin end 104 and/or the box end 108 may include straight or tapered threads. For instance, the box end 108 includes tapered threads 112. Inasmuch as the female threads 112 are tapered, the size of the thread 112 at or near the trailing edge 120 of the box end 108 may be larger than the size of male threads 110, and the female threads 112 may taper to a reduced size more similar to the size of male threads 110.

The male thread 110 can begin proximate a leading edge 114 of the pin end 104. For example, FIG. 1 illustrates that the male thread 110 can be offset a distance (shown has a linear distance 116) from the leading edge 114 of the pin end 104. The offset distance 116 may vary as desired, and can particularly be different based on the size of the drill string component 102, configuration of the thread 110, or based on other factors. In at least one implementation, the offset distance 116 is between about one-half and about twice the width 118 of the male thread 110. Alternatively, the offset distance 116 may be greater or lesser. For example, in one or more implementations the offset distance 116 is zero such that the male thread 110 begins at the leading edge 114 of the pin end 104.

Similarly, female thread 112 can begin proximate a trailing edge 120 of the box end 108. For example, FIG. 1 illustrates that the female thread 112 can be offset a distance (shown has a linear distance 122) from the trailing edge 120 of the pin end 104. The offset distance 122 may vary as desired, and can particularly be different based on the size of the drill string component 106, configuration of the female thread 112, or based on other factors. In at least one implementation, the offset distance 122 is between about one-half and about twice the width 124 of the female thread 112. Alternatively, the offset distance 122 may be greater or lesser. For example, in one or more implementations the offset distance 122 is zero such that the female thread 112 begins at the trailing edge 120 of the pin end 104.

Furthermore, the offset distance 116 can be equal to the offset distance 122 as shown in FIG. 1. In alternative implementations, the offset distance 122 may be greater or smaller than the offset distance 116. In any event, as the leading edge 114 of the pin end 104 is inserted into the box end 108 and rotated, the male thread 110 may engage the female thread 112, and the pin end 104 may advance linearly along a central axis 126 of the box end 108.

More particularly, the male and female threads 110, 112 can be helically disposed relative to the respective pin and box ends 104, 108. In other words, each of the male thread 110 and the female thread 112 can comprise a plurality of helical turns extending along the respective drill string component 102, 106. As the male and female threads 110, 112 mate, the threads may therefore rotate relative to each other and fit within gaps between corresponding threads. In FIG. 1, the male thread 110 generally winds around pin end 104 at an angle 128, which can also be measured relative to the leading edge 114 of the pin end 114.

The male thread 110 can include a thread width 118 and the female thread 112 can include a thread width 124 as previously mentioned. As used herein the term "thread width" can comprise the linear distance between edges of a thread crest as measured along a line normal to the edges of the thread crest. One will appreciate that the thread widths 118, 124 can vary depending upon the configuration of the threads 110, 112. In one or more implementations, the thread width 118 of the male thread 110 is equal to the thread width 124 of the female thread 112. In alternative implementations, the thread width 118 of the male thread 110 is larger or smaller than the thread width 124 of the female thread 112.

The male thread 110 can include a thread depth 130 and the female thread 112 can include a thread depth 132. As used herein the term "thread depth" can comprise the linear distance from the surface from which the thread extends (i.e., the outer surface of the pin end 104 or inner surface of the box end 108) to most radially distal point on the thread crest as measured along a line normal to the surface from which the thread extends. One will appreciate that the thread depths 130, 132 can vary depending upon the configuration of the threads 110, 112 and/or the size of the drill string components 102, 106. In one or more implementations, the thread depth 130 of the male thread 110 is equal to the thread depth 132 of the female thread 112. In alternative implementations, the thread depth 130 of the male thread 110 is larger or smaller than the thread depth 132 of the female thread 112.

In one or more implementations, the thread width 118, 124 of each thread 110, 112 is greater than the thread depth 130, 132 of each thread 110, 112. For example, in one or more implementations, the thread width 118, 124 of each thread 110, 112 is at least two times the thread depth 130, 132 of each thread 110, 112. In alternative implementations, the thread width 118, 124 of each thread 110, 112 is approximately equal to or less than the thread depth 130, 132 of each thread 110, 112.

As alluded to above, both the male and female threads 110, 112 can include a leading end or thread start. For example, FIG. 1 illustrates that the male thread 110 can include a thread start or leading end 134. Similarly, the female thread 112 can include a thread start or leading end 136.

In one or more implementations, the leading end 134 of the male thread 110 can comprise a planar surface that extends from the outer surface of the pin end 104. For example, the leading end 134 of the male thread 110 can comprise a planar surface that extends radially outward from the outer surface of the pin end 104, thereby forming a face surface. In one or more implementations the leading end 134 extends in a direction normal to the outer surface of the pin end 104. In alternative implementations, the leading end 134 extends in a direction substantially normal to the outer surface of the pin end 104 (i.e., in a direction oriented at an angle less than about 15 degrees to a direction normal to the outer surface of the pin end 104). In still further implementations, the leading end 134 can comprise a surface that curves along one or more of its height or width.

Furthermore, in one or more implementations the leading end 134 of the male thread 110 can extend the full thread width 118 of the male thread 110. In other words, the leading end 134 of the male thread 110 can extend from a leading edge 140 to a trailing edge 138 of the male thread 110. Thus, the planar surface forming the leading end 134 can span the entire thread width 118 of the male thread 110.

Additionally, in one or more implementations the leading end 134 of the male thread 110 can extend the full thread depth 130 of the male thread 110. In other words, a height of the leading end 134 of the male thread 110 can be equal to the thread depth 130. Thus, the planar surface forming the leading end 134 can span the entire thread depth 130 of the male thread 110. As such, the leading end 134 or thread start can comprise an abrupt transition to the full depth and/or width of the male thread 110. In other words, in one or more implementations, the male thread 110 does not include a tail end that tapers gradually to the full depth of the male thread 110.

Along similar lines, the leading end 136 of the female thread 112 can comprise a planar surface that extends from the inner surface of the box end 108. For example, the leading end 136 of the female thread 112 can comprise a planar surface that extends radially inward from the inner surface of the box end 108, thereby forming a face surface. In one or more implementations the leading end 136 extends in a direction normal to the inner and/or outer surface of the box end 108. In alternative implementations, the leading end 136 extends in a direction substantially normal to the inner or outer surface of the box end 108 (i.e., in a direction oriented at an angle less than about 15 degrees to a direction normal to the inner and/or outer surface of the box end 108). In still further implementations, the leading end 136 can comprise a surface that curves along one or more of its height or width. For example, the leading end 134 and the leading end 136 can comprise cooperating curved surfaces.

Furthermore, in one or more implementations the leading end 136 of the female thread 112 can extend the full thread width 124 of the female thread 112. In other words, the leading end 136 of the female thread 112 can extend from a leading edge 142 to a trailing edge 144 of the female thread 112. Thus, the planar surface forming the leading end 136 can span the entire thread width 124 of the female thread 112.

Additionally, in one or more implementations the leading end 136 of the female thread 112 can extend the full thread depth 132 of the female thread 112. In other words, a height of the leading end 136 of the female thread 112 can be equal to the thread depth 132. Thus, the planar surface forming the leading end 136 can span the entire thread depth 132 of the female thread 112. As such, the leading end 136 or thread start can comprise an abrupt transition to the full depth and/or width of the female thread 112. In other words, in one or more implementations, the female thread 112 does not include a tail end that tapers gradually to the full depth of the female thread 112. In the illustrated implementation, the leading end or thread start 136 of the female thread 112 is illustrated as being formed by material that remains after machining or another process used to form the threads. Thus, the leading end or thread start 136 may be, relative to the interior surface of the box end 108, embossed rather than recessed.

In one or more implementations, the leading end 134 of the male thread 110 can have a size and/or shape equal to the leading end 136 of the female thread 112. In alternative implementations, the size and/or shape of the leading end 134 of the male thread 110 can differ from the size and/or shape of the leading end 136 of the female thread 112. For example, in one or more implementations the leading end 134 of the male thread 110 can be larger than the leading end 136 of the female thread 112.

In one or more implementations, the leading ends 134, 136 of the male and female threads 110, 112 can each have an off-axis orientation. In other words, the planar surfaces of the leading ends 134, 136 of the male and female threads 110, 112 can each extend in a direction offset or non-parallel to a central axis 126 of the drill string components 102, 106. For example, as illustrated by FIG. 1, the planar surface of the leading end 134 of the male thread 110 can face an adjacent turn of the male thread 110. Similarly, planar surface of the leading end 136 of the female thread 112 can face an adjacent turn of the female thread 112.

More particularly, the planar surface of the leading end 134 of the male thread 110 can extend at an angle relative to the leading edge 114 or the central axis 126 of the pin end 104. For instance, in FIG. 1, the planar surface of the leading end 134 of the male thread 110 is oriented at an angle 146 relative to the central axis 126 of the drill string component 102, although the angle may also be measured relative to the leading edge 114. The illustrated orientation and existence of a planar surface of the leading end 134 is particularly noticeable when compared to traditional threads, which taper to a point such that there is virtually no distance between the leading and trailing edges of a thread, thereby providing no face surface.

Similar to the leading end 134, the leading end 136 of the female thread 112 can extend at an angle relative to the trailing edge 120 or the central axis 126 of the pin end 104. For instance, in FIG. 1, the planar surface of the leading end 136 of the female thread 112 is oriented at an angle 148 relative to the central axis 126 of the drill string component 106, although the angle may also be measured relative to the trailing edge 120.

The angles 146, 148 can be varied in accordance with the present disclosure and include any number of different angles. The angles 146, 148 may be varied based on other characteristics of the threads 110, 112, or based on a value that is independent of thread characteristics. In one or more implementations, angle 146 is equal to angle 148. In alternative implementations, the angle 146 can differ from angle 148.

In one or more implementations the angles 146, 148 are each acute angles. For example, each of the angles 146, 148 can comprise an angle between about 10 degrees and 80 degrees, about 15 degrees and about 75 degrees, about 20 degrees and about 70 degrees, about 30 degrees and about 60 degrees, about 40 degrees and about 50 degrees. In further implementations, the angles 146, 148 can comprise about 45 degrees. One will appreciate in light of the disclosure herein that upon impact between two mating leading ends 134, 136 or start faces with increasing angles 146, 148, there is decreasing loss of momentum and decreasing frictional resistance to drawing the threads 110, 112 into a fully mating condition. In any event, a leading end 134 of the male thread 110 can mate with the leading end 136 of the female thread 112 to aid in making a joint between the first drill string component 102 and the second drill string component 106.

By eliminating the long tail of a thread start and replacing the tail with a more abrupt transition to the full height of the thread 110, 112, a leading ends 134, 136 or thread start face can thus be provided. Moreover, while the leading ends 134, 136 may be angled or otherwise oriented with respect to an axis 126, the thread start face may also be normal to the major and/or minor diameters of cylindrical surfaces of the corresponding pin and box ends 104, 108. Such geometry eliminates a tail-type thread start that can act as a wedge, thereby eliminating geometry that leads to wedging upon mating of the pin and box ends 104, 108.

Moreover, as the pin and box ends 104, 108 are drawn together, the leading ends 134, 136 or thread starts may have corresponding surfaces that, when mated together, create a sliding interface in a near thread-coupled condition. For instance, where the leading ends 134, 136 are each oriented at acute angles, the leading ends 134, 136 or thread start faces may engage each other and cooperatively draw threads into a fully thread-coupled condition. By way of example during make up of a drill rod assembly, as the pin end 104 is fed into the box end 108, the leading ends 134, 136 can engage and direct each other into corresponding recesses between threads. Such may occur during rotation and feed of one or both of the drill string components 102, 106. Furthermore, since thread start tails are eliminated, there are few—if any—limits on rotational positions for mating. Thus, the pin and box ends 104, 108 can have the full circumference available for mating, with no jamming prone positions.

In one or more implementations, a thread 110 may be formed with a tail using conventional machining processes. The tail may be least partially removed to form the leading end 134. In such implementations, a tail may extend around approximately half the circumference of a given pin end 104. Consequently, if the entire tail of the thread 110 is removed, the thread 110 may have a leading end 134 aligned with the axis 126. If, however, more of the thread 110 beyond just the tail is removed, leading end 134 may be offset relative to the axis 126. The tail may be removed by a separate machining process. IN Although this example illustrates the removal of a tail for formation of a thread start, in other embodiments a thread start face may be formed in the absence of creation and/or subsequent removal of a tail-type thread start. For example, instead of using conventional machining processes, the thread is formed using electrical discharge machining. Electrical discharge machining can allow for the formation of the leading end 134 since metal can be consumed during the process. Alternatively, electrochemical machining or other processes that consume material may also be used to form the leading ends 134, 136 of the threads 110, 112.

As previously mentioned, in one or more implementations the drill string components 102, 106 can comprise hollow bodies. More specifically, in one or more implementations the drill string components can be thin-walled. In particular, as shown by FIG. 1, the drill string component 106 can include an outer diameter 150, an inner diameter 152, and a wall thickness 154. The wall thickness 154 can equal one half of the outer diameter 150 minus the inner diameter 152. In one or more implementations, the drill string component 106 has a wall thickness 154 between about approximately 5 percent and 15 percent of the outer diameter 150. In further implementations, the drill string component 106 has a wall thickness 154 between about approximately 6 percent and 8 percent of the outer diameter 150. One will appreciate that such thin-walled drill string components can limit the geometry of the threads 112. However, a thin-walled drill string component can nonetheless includes a leading end 134, 136 as described hereinabove despite such limitations.

Figure 2:
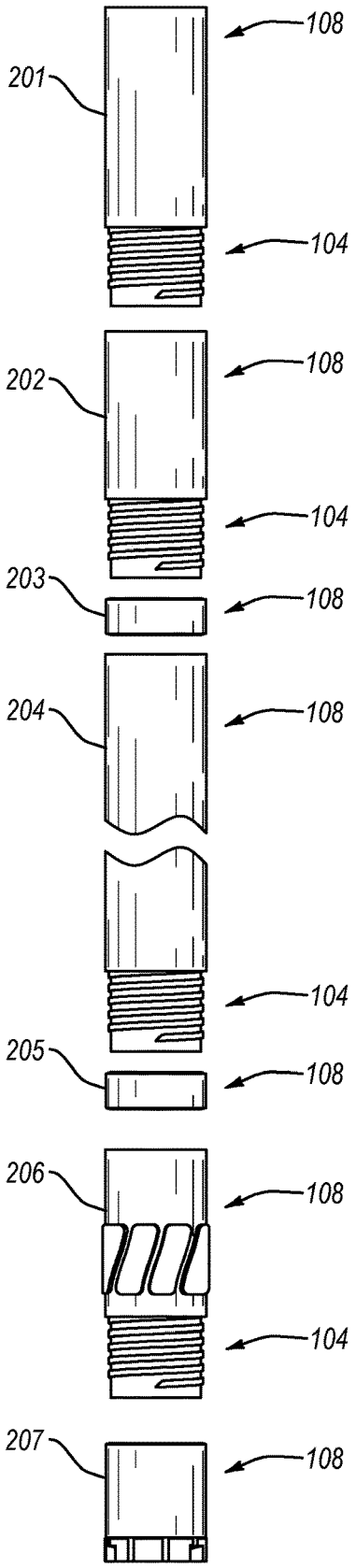
FIG. 2 illustrates a side view of an exploded drill string having drill string components having leading ends in accordance with one or more implementations of the present invention.

Referring now to FIG. 2, the drill string components 102, 106 can comprise any number of different types of tools. In other words, virtually any threaded member used on a drill string can include one or more of a box end 108 and a pin end 104 having leading ends or thread starts as described in relation to FIG. 1. For example, FIG. 2 illustrates that drill string components can include a locking coupling 201, an adaptor coupling 202, a drill rod 204, and a reamer 206 can each include both a pin end 104 and a box end 108 with leading ends 134, 136 that resist or reduce jamming and cross-threading as described above in relation to FIG. 1. FIG. 2 further illustrates that drill string components can include a stabilizer 203, a landing ring 205 and a drill bit 207 including a box end 108 with a leading end 136 that resists or reduces jamming and cross-threading as described above in relation to FIG. 1. In yet further implementations, the drill string components 102, 106 can comprise casings, reamers, core lifters, or other drill string components.

Figure 3:
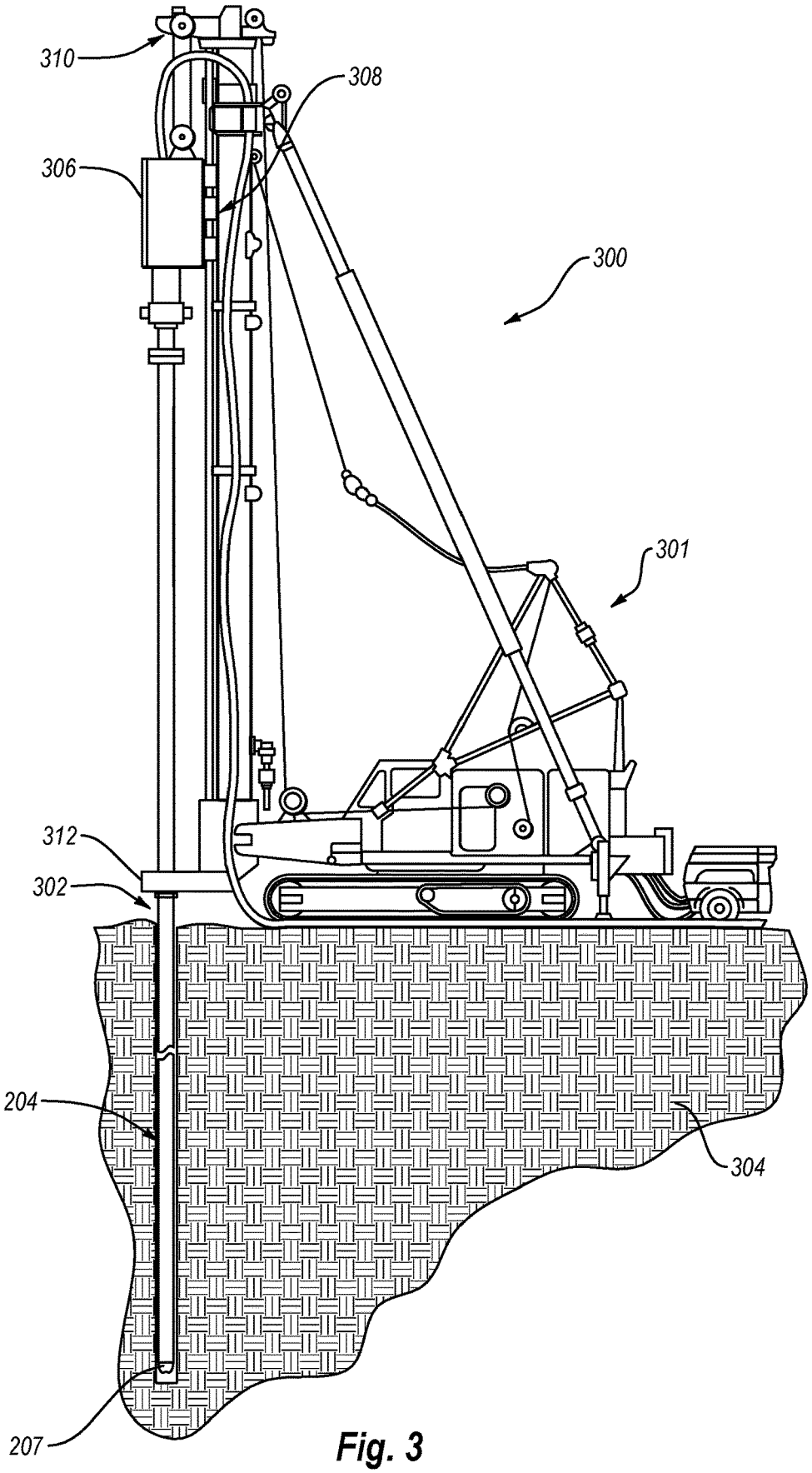
FIG. 3 illustrates a schematic diagram of a drilling system including drill string components having leading ends in accordance with one or more implementations of the present invention.

Referring now to FIG. 3, a drilling system 300 may be used to drill into a formation 304. The drilling system 300 may include a drill string 302 formed from a plurality of drill rods 204 or other drill string components 201-207. The drill rods 204 may be rigid and/or metallic, or alternatively may be constructed from other suitable materials. The drill string 302 may include a series of connected drill rods that may be assembled section-by-section as the drill string 302 advances into the formation 304. A drill bit 207 (for example, an open-faced drill bit or other type of drill bit) may be secured to the distal end of the drill string 302. As used herein the terms "down," "lower," "leading," and "distal end" refer to the end of the drill string 302 including the drill bit 207. While the terms "up," "upper," "trailing," or "proximal" refer to the end of the drill string 302 opposite the drill bit 207.

The drilling system 300 may include a drill rig 301 that may rotate and/or push the drill bit 207, the drill rods 204 and/or other portions of the drill string 302 into the formation 304. The drill rig 301 may include a driving mechanism, for example, a rotary drill head 306, a sled assembly 308, and a mast 310. The drill head 306 may be coupled to the drill string 302, and can rotate the drill bit 207, the drill rods 204 and/or other portions of the drill string 302. If desired, the rotary drill head 306 may be configured to vary the speed and/or direction that it rotates these components. The sled assembly 308 can move relative to the mast 310. As the sled assembly 308 moves relative to the mast 310, the sled assembly 308 may provide a force against the rotary drill head 306, which may push the drill bit 207, the drill rods 204 and/or other portions of the drill string 302 further into the formation 304, for example, while they are being rotated.

It will be appreciated, however, that the drill rig 301 does not require a rotary drill head, a sled assembly, a slide frame or a drive assembly and that the drill rig 301 may include other suitable components. It will also be appreciated that the drilling system 300 does not require a drill rig and that the drilling system 300 may include other suitable components that may rotate and/or push the drill bit 207, the drill rods 204 and/or other portions of the drill string 302 into the formation 304. For example, sonic, percussive, or down hole motors may be used.

As shown by FIG. 3, the drilling system 300 can further include a drill rod drill rod clamping device 312. In further detail, the driving mechanism may advance the drill string 302 and particularly a first drill rod 204 until a trailing portion of the first drill rod 204 is proximate an opening of a borehole formed by the drill string 302. Once the first drill rod 204 is at a desired depth, the drill rod clamping device 312 may grasp the first drill rod 204, which may help prevent inadvertent loss of the first drill rod 204 and the drill string 302 down the borehole. With the drill rod clamping device 312 grasping the first drill rod 204, the driving mechanism may be disconnected from the first drill rod 204.

An additional or second drill rod 204 may then be connected to the driving mechanism manually or automatically using a drill rod handling device, such as that described in U.S. Patent Application Publication No. 2010/0021271, the entire contents of which are hereby incorporated by reference herein. Next driving mechanism can automatically advanced the pin end 104 of the second drill rod 204 into the box end 108 of the first drill rod 204. A joint between the first drill rod 204 and the second drill rod 204 may be made by threading the second drill rod 204 into the first drill rod 204. One will appreciate in light of the disclosure herein that the leading ends 134, 136 of the male and female threads 110, 112 of the drill rods 204 can prevent or reduce jamming and cross-threading even when the joint between the drill rods 204 is made automatically by the drill rig 301.

After the second drill rod 204 is connected to the driving mechanism and the first drill rod 204, the drill rod clamping device 312 may release the drill 302. The driving mechanism may advance the drill string 302 further into the formation to a greater desired depth. This process of grasping the drill string 302, disconnecting the driving mechanism, connecting an additional drill rod 204, releasing the grasp, and advancing the drill string 302 to a greater depth may be repeatedly performed to drill deeper and deeper into the formation.

Accordingly, FIGS. 1-3, the corresponding text, provide a number of different components and mechanisms for making joints between drill string components while reducing or eliminating jamming and cross-threading. In addition to the foregoing, implementations of the present invention can also be described in terms acts and steps in a method for accomplishing a particular result. For example, a method of a method of making a joint in a drill string without jamming or cross threading is described below with reference to the components and diagrams of FIGS. 1 through 3.

The method can involve inserting a pin end 104 of a first drill string component 102 into a box end 108 of a second drill string component 106. The method can also involve rotating the first drill sting component 102 relative to the second drill string component 108. The method can further involve abutting a planar leading end 134 of a male thread 110 on the pin end 104 of the first drill string component 102 against a planar leading end 136 of a female thread 112 on the box end 108 of the second drill string component 106.

The planar leading end 134 of the male thread 110 can be oriented at an acute angle 146 relative to a central axis 26 of the first drill string component 102. Similarly, the planar leading end 136 of the female thread 112 can be oriented at an acute angle 148 relative to a central axis 26 of the second drill string component 106.

The method can further involve sliding the planar leading end 134 of the male thread 110 against and along the planar leading end 136 of the female thread 112 to guide the male thread 110 into a gap between turns of the female thread 112. Sliding the planar leading end 134 of the male thread 110 against and along the planar leading end 136 of the female thread 112 can cause the first drill string component 102 to rotate relative to the second drill string component 106 due to the acute angles 146, 148 of the planar leading ends 134, 136 of the male and female threads 110, 112. The method can involve automatically rotating and advancing the first drill sting component 102 relative to the second drill string component 106 using a drill rig 301 without manually handling the drill string components 106, 108.

The planar leading end 136 of the female thread 112 can extend along an entire depth 132 of the female thread 110. The planar leading end 134 of the male thread 110 can extend along an entire depth 130 of the male thread 110. When rotating the first drill sting component 102 relative to the second drill string component 108, the depths of the planar leading ends 134, 136 of the female thread 112 and the male thread 110 can prevent jamming or wedging of the male and female threads 110, 112.

Thus, implementations of the foregoing provide various desirable features. For instance, by including leading ends or start faces which are optionally the full width of the thread, the tail-type thread start can be eliminated, thereby allowing: (a) substantially full circumference rotational positioning for threading; and (b) a guiding surface for placing mating threads into a threading position. For instance, the angled start face can engage a corresponding thread or thread start face and direct the corresponding thread into a threading position between helical threads. Moreover, at any position of the corresponding threads, the tail has been eliminated to virtually eliminate wedging prone geometry.

Similar benefits may be obtained regardless of whether threading is concentric or off-center in nature. For instance, in an off-center arrangement, a line intersecting a thread crest and a thread start face may include a joint taper. Under feed, the thread start face can mate with the mating thread crest in a manner that reduces or eliminates wedging as the intersection and subsequent thread resist wedging, jamming, and cross-threading. In such an embodiment, a joint taper may be sufficient to reduce the major diameter at a smaller end of a male thread to be less than a minor diameter at a large end of a female thread. Thus, off-center threading may be used for tapered threads.

Threads of the present disclosure may be formed in any number of suitable manners. For instance, as described previously, turning devices such as lathes may have difficulty creating an abrupt thread start face such as those disclosed herein. Accordingly, in some embodiments, a thread may be formed to include a tail. A subsequent grinding, milling, or other process may then be employed to remove a portion of the tail and create a thread start such as those described herein, or may be learned from a review of the disclosure herein. In other embodiments, other equipment may be utilized, including a combination of turning and other machining equipment. For instance, a lathe may produce a portion of the thread while other machinery can further process a male or female component to add a thread start face. In still other embodiments, molding, casting, single point cutting, taps and dies, die heads, milling, grinding, rolling, lapping, or other processes, or any combination of the foregoing, may be used to create a thread in accordance with the disclosure herein.

The present invention can thus be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The invention claimed is:

1. A threaded drill string component that resists jamming and cross threading, comprising:

a hollow body having a first end, an opposing second end, and a central axis extending through the hollow body; and a thread positioned on the first end of the hollow body, the thread having a width, wherein:

the thread comprises a plurality of helical turns extending along the first end of the hollow body, the thread comprises a leading end proximate the first end of the hollow body, the leading end of the thread is orientated at an acute angle relative to the central axis of the hollow body, the leading end of the thread faces toward an adjacent turn of the thread, the leading end of the thread extends the full thread width from a leading edge of the thread to a trailing edge of the thread, the leading end of the thread comprises a planar surface extending normal to the hollow body, the thread is tapered relative to the central axis, the leading edge of the thread defines a clearance flank oriented at an angle of at least 45 degrees relative to a transverse axis that is perpendicular to the hollow body, and at least a portion of the trailing edge of the thread is oriented in a negative direction relative to the transverse axis.

2. The drill string component as recited in claim 1, wherein the thread has a thread depth, and wherein the leading end of the thread has a height equal to the thread depth.

3. The drill string component as recited in claim 2, wherein the thread width is at least two times the thread depth.

4. The drill string component as recited in claim 1, wherein the acute angle is between approximately 15 degrees and approximately 75 degrees.

5. The drill string component as recited in claim 4, wherein the acute angle is between approximately 30 degrees and approximately 60 degrees.

6. The drill string component as recited in claim 5, wherein the acute angle is between approximately 40 degrees and approximately 50 degrees.

7. The drill string component as recited in claim 1, wherein the hollow body is a thin-walled body having a wall thickness between approximately 5 percent and 15 percent of an outer diameter of the hollow body.

8. The drill string component as recited in claim 1, wherein the first end comprises a box end and the thread comprises a female thread.

9. The drill string component as recited in claim 8, further comprising a second thread positioned on the second end of the hollow body; wherein:

the second thread comprises a plurality of helical turns extending along the second end of the hollow body, the second thread comprises a leading end proximate the second end of the hollow body, the leading end of the second thread is orientated at an acute angle relative to the central axis of the hollow body, the leading end of the second thread faces toward an adjacent turn of the second thread, and the second thread is tapered relative to the central axis.

10. The drill string component as recited in claim 9, wherein the second end comprises a pin end and the second thread comprises a male thread.

11. The drill string component as recited in claim 1, wherein the drill string component comprises one of a drill rod, a casing, an adaptor coupling, a reamer, a drill bit, a core lifter, a locking coupling, a landing ring, or a stabilizer.

12. The drill string component as recited in claim 1, wherein the taper of the thread ranges from about 0.75 to about 1.6 degrees relative to the central axis.

13. The drill string component as recited in claim 1, wherein the leading end of the thread does not comprise a thread start tail.

14. A threaded drill string component that resists jamming and cross threading during engagement with adjacent drill string components within a drill string, comprising:

a body, a box end, an opposing pin end, and a central axis extending through the body;

a female thread positioned on the box end of the body, the female thread having a depth and a width and being tapered relative to the central axis; and a male thread positioned on the pin end of the body, the male thread having a depth and a width and being tapered relative to the central axis, wherein:

each of the female thread and the male thread comprises a plurality of helical turns, each of the female thread and the male thread comprises a leading end and an opposing trailing end, the leading end of each of the female thread and the male thread extends the full thread width from a leading edge of the thread to a trailing edge of the thread, the leading end of each of the female thread and the male thread comprises a planar surface extending normal to the body, the leading edge of the female thread defines a clearance flank oriented at an angle of at least 45 degrees relative to a first transverse axis that is perpendicular to the body, at least a portion of the trailing edge of the female thread is oriented in a negative direction relative to the first transverse axis, the leading edge of the male thread defines a clearance flank oriented at an angle of at least 45 degrees relative to a second transverse axis that is perpendicular to the body, and at least a portion of the trailing edge of the male thread is oriented in a negative direction relative to the second transverse axis, and the female thread tapers to a reduced size as it moves away from the trailing edge of the box end.

15. The drill string component as recited in claim 14, wherein:

the leading end of the female thread faces toward an adjacent turn of the female thread; and the leading end of the male thread faces toward an adjacent turn of the male thread.

16. The drill string component as recited in claim 15, wherein the planar surfaces of the female thread and the male thread each extend at an acute angle relative to the central axis of the body.

17. The drill string component as recited in claim 16, wherein the acute angle is between approximately 15 degrees and approximately 75 degrees.

18. The drill string component as recited in claim 17, wherein the drill string component comprises a drill rod.

19. The drill string component as recited in claim 14, wherein the tapers of the male and female threads range from about 0.75 to about 1.6 degrees relative to the central axis.

20. The drill string component as recited in claim 14, wherein the leading ends of the male and female threads do not comprise a thread start tail.

* * * * *